US008038422B2

(12) United States Patent
Triebe et al.

(10) Patent No.: US 8,038,422 B2
(45) Date of Patent: Oct. 18, 2011

(54) GEAR PUMP WITH A VALVE ARRANGED BETWEEN A SUCTION SIDE AND A PRESSURE SIDE OF THE GEAR PUMP

(75) Inventors: René Triebe, Zuerich (CH); Stefan Weber, Berikon (CH)

(73) Assignee: MAAG Pump Systems AG, Oberglatt (CH)

( * ) Notice: Subject to any disclaimer, the term of this patent is extended or adjusted under 35 U.S.C. 154(b) by 413 days.

(21) Appl. No.: 12/294,330

(22) PCT Filed: May 14, 2007

(86) PCT No.: PCT/EP2007/054660

§ 371 (c)(1),
(2), (4) Date: Sep. 24, 2008

(87) PCT Pub. No.: WO2007/131994

PCT Pub. Date: Nov. 22, 2007

(65) Prior Publication Data

US 2009/0169408 A1 Jul. 2, 2009

(30) Foreign Application Priority Data

May 12, 2006 (EP) ..... 06113845

(51) Int. Cl.

| | |
|---|---|
| ***F01C 21/10*** | (2006.01) |
| ***F03C 2/00*** | (2006.01) |
| ***F03C 4/00*** | (2006.01) |
| ***F04C 2/00*** | (2006.01) |

(52) U.S. Cl. ..... 418/150; 418/102; 418/206.1

(58) Field of Classification Search ..... 418/102, 418/141, 150, 201.2, 206.1, 206.6–206.8, 418/270

See application file for complete search history.

(56) References Cited

U.S. PATENT DOCUMENTS 3,703,273 A 11/1972 Illing
5,544,855 A 8/1996 Henken et al.

(Continued)

FOREIGN PATENT DOCUMENTS

DE 644570 C * 4/1937

(Continued)

OTHER PUBLICATIONS

International Search Report; International Application No. PCT/EP2007/054660; International Filing Date: May 14, 2007.

(Continued)

*Primary Examiner* — Theresa Trieu
(74) *Attorney, Agent, or Firm* — Antonelli, Terry, Stout & Kraus, LLP.

(57) ABSTRACT

Gearwheel pump, having a housing with at least two intermeshing gears with shafts supported by slide bearings lubricated with pumping medium (M) fed from a suction side to a pressure side, a return duct which leads pumping medium which flows outward through the plain bearing back to the suction side, and a valve (5) having a stationary part and a moveable part (20, 21). The valve (5) has a setting characteristic which runs, as a first approximation, linearly at least in one region, wherein the setting characteristic is defined by a differential pressure (Δp) across the valve as a function of a setting path (x) in the valve (5) thereby significantly improving capability for setting the pressure in the transition region between the plain bearing and a dynamic seal of a driveshaft which is guided outward.

15 Claims, 6 Drawing Sheets

U.S. PATENT DOCUMENTS

| | | | | |
|---|---|---|---|---|
| 6,123,531 | A * | 9/2000 | Blume et al. | 418/102 |
| 6,802,702 | B2 * | 10/2004 | Gillert et al. | 418/102 |
| 6,935,851 | B2 * | 8/2005 | Peters et al. | 418/206.1 |

FOREIGN PATENT DOCUMENTS

| | | | | |
|---|---|---|---|---|
| EP | 0 301 578 | A | | 2/1989 |
| EP | 0 643 244 | A1 | | 3/1995 |
| GB | 2 208 421 | A | | 3/1989 |
| JP | 08 303356 | A | | 11/1996 |
| JP | 09144668 | A | * | 6/1997 |
| JP | 10 331779 | A | | 12/1998 |

OTHER PUBLICATIONS

International Preliminary Report on Patentability issued Nov. 17, 2008 in International Application No. PCT/EP2007/054660; International Filing Date: May 14, 2007.

The English translation of the International Preliminary Report on Patentability issued Dec. 10, 2008 in International Application No. PCT/EP2007/054660; International Filing Date: May 14, 2007.

* cited by examiner

GEAR PUMP WITH A VALVE ARRANGED BETWEEN A SUCTION SIDE AND A PRESSURE SIDE OF THE GEAR PUMP

RELATED APPLICATION

This is a U.S. national phase application under 35 U.S.C. §371 of International Application No. PCT/EP2007/054660 filed May 14, 2007 and claiming priority of European Application No. EP 06 113 845.9 filed May 12, 2006.

TECHNICAL FIELD

The present invention relates to a gear pump comprising a housing with at least two intermeshing gears each with a shaft supported by slide bearings lubricated with pumping medium, the pumping medium getting from a suction side to a pressure side and a return duct being provided, which leads pumping medium flowing to the outside via the slide bearing back to the suction side, and with a valve, which includes a movable and a stationary part, for the adjustment of a pressure difference in function of an adjustment path, which indicates a position between the stationary and the movable part.

BACKGROUND AND SUMMARY

Substantially, gear pumps consist of a housing with two intermeshing gears, which are arranged on shafts, at least one of the shafts being connected to a drive. The shafts are supported by slide bearings lubricated with pumping medium, which slide bearings are immediately arranged next to the internal space of the pump. The pumping medium used for the lubrication of the slide bearings gets from the pressure side via the gap of the slide bearing and a return duct into the suction side of the gear pump.

Gear pumps in particular, which are used for the conveying of low-viscous polymers and prepolymers and which comprise a dynamic sealing—in the form of a labyrinth sealing (sealing of threaded mandrel) for example—and subsequent static sealing—a packing sealing with or without sealing medium, for example—, must be ensured that always a positive pressure with respect to the suction side is present ahead of the dynamic mandrel sealing, since otherwise—in using a sealing medium—this can get into the pumping medium, which is highly undesirable. The positive pressure is necessary in order to get a sufficient filling of the sealing gap of the dynamic sealing. Thus, a penetration of sealing medium can be prevented into the main stream of the pumping medium.

On the other side, the pressure should not be too high in front of the dynamic mandrel sealing, since otherwise pumping medium can get outside via the dynamic mandrel sealing or—if a static sealing is present—the pumping medium gets in contact with this sealing, whereby a destruction of the static sealing must be expected.

Furthermore, it must be ensured that the return duct can be closed at the static sealing during maintenance work. For this reason, a valve has been provided in the return duct, by which a penetration of air into the suction side of the gear pump can be cut off.

However, the known valve is not suitable to meet the aforementioned conditions for the adjustment of the pressure of the pumping medium in front of the dynamic mandrel sealing. Thus, due to the adjustment characteristic of the known valve, it is uttermost difficult to adjust a pressure of a pumping medium in front of the dynamic sealing in complying with the afore-mentioned pressure conditions, since the range is very small, in which an adjustment must be made.

Therefore, the present invention has the object to provide a gear pump, which does not have the afore-mentioned drawbacks.

This object is solved by the present invention wherein the valve of the gear pump has an adjustment range, in which the pressure difference in function of the adjustment path has a slope between 0.05 and 2.5 bar per percentage of a maximum adjustment path, and wherein the adjustment range is at least 50% of the maximum adjustment path. Further embodiments of the present invention are described below.

The present invention relates to a gear pump consisting of a housing with at least two intermeshing gears, each with a shaft, which is supported by slide bearings lubricated with pumping medium. A pumping medium is conveyed from a suction side to a pressure side, and a return duct is provided, which leads pumping medium flowing to the outside via the slide bearing back to the suction side, and with a valve having a movable and a stationary part for the adjustment of a pressure difference in function of a adjustment path, which indicates a position between the stationary and the movable part. According to the present invention, the valve comprises an adjustment range, in which the pressure difference in function of the adjustment path comprises a slope between 0.05 and 2.5 bar per percentage of a maximum adjustment path. Furthermore, the adjustment range comprises at least 50% of the maximum adjustment path.

It arises as unit for the slope "bar per percentage of the maximum adjustment path $x_{max}$". This unit is valid for all values indicated in this description for the slope for the course of the pressure difference in function of the adjustment path.

Therewith, a considerable improvement of the adjustment possibility of the pressure is obtained in the transition range between the slide bearing and a dynamic sealing of a drive shaft directed to the outside. In general, a good-natured adjustment characteristic has been obtained.

An embodiment of the gear pump according to the present invention is characterized in that the pressure difference in function of the adjustment path comprises a slope between 0.05 and 2 bar per percentage of the maximum adjustment path, particularly between 0.05 and 1.75 bar per percentage of the maximum adjustment path.

A further embodiment of the gear pump according to the present invention is characterized in that a closing range is provided, in which the pressure difference in function of the adjustment path is higher than 2.5 bar per percentage of the maximum adjustment path, the closing range comprising preferably 10 to 15% of the maximum adjustment path.

In a further embodiment of the present invention, the valve is contained in the return duct.

Alternatively, to the preceding embodiment of the present invention, the valve is contained in a feeding duct, which leads from the pressure side to the region arranged behind the slide bearing, viewed from the gears.

In an embodiment of the present invention, the valve comprises a pressure adjustment section, which mainly serves for the pressure adjustment. Furthermore, the valve comprises a closing section, by which the duct containing the valve can be opened or closed, respectively.

In a further embodiment of the present invention, the movable part is insert-able into the stationary part.

In another embodiment, the movable and the stationary part contact each other in the closing section if the duct containing the valve is closed.

In another embodiment of the present invention, the valve comprises a pressure adjustment section, which serves mainly for the adjustment of the pressure, and a closing section, in which the duct containing the valve can be opened or closed, respectively, the adjustment characteristic running linearly in the pressure adjustment section in a first approximation.

In a further embodiment of the present invention, the stationary part is an exchangeable sleeve.

In another further embodiment of the present invention, the valve comprises the following dimensions:

x: 0.5*D . . . 5*D, particularly 3*D;

S1: 0.008*D . . . 0.08*D;

di: di<D, di=D/1.5 . . . D/1.2;

x being the adjustment path, D the diameter of the movable part, di the passage opening in the closing section, and S1 the gap width between the stationary and the movable part.

In another embodiment of the present invention, the movable part is merely translatory displaceable.

In another embodiment of the present invention, a mandrel lifting drive is provided in order to displace the movable part in a translatory manner.

In another embodiment of the present invention, the movable part facing the end of the suction side is tapered, globular or flat.

A further embodiment of the present invention is characterized in that the movable part comprises one of the following cross-sections:

Polygon, particularly a triangle, quadrangle or hexagon;

oval;

round.

Finally, a further embodiment of the present invention consists in that the closing section is provided after the pressure adjustment section in flow direction of the pumping medium.

The present invention is further explained with the aid of exemplified embodiments, which are shown in figures.

DETAILED DESCRIPTION

Figure 1:
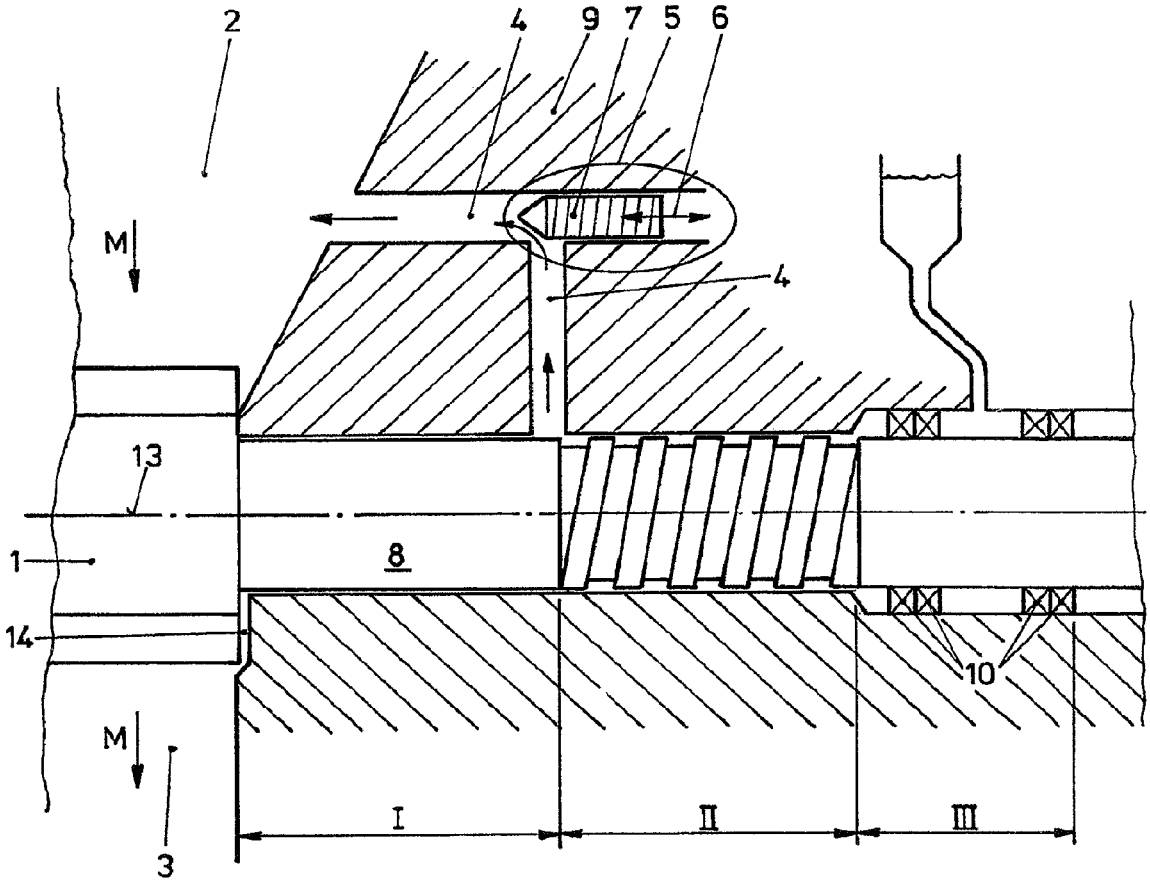
FIG. 1 a section along an axis of rotation of a drive shaft of a gear pump, directed to the outside, depicted schematically, FIGS. 2 to 4 different embodiments of a valve according to the present invention, FIGS. 5A, 5B and 5C possible adjustment characteristics for the different embodiments according to FIGS. 2 to 4, FIG. 6 a further embodiment of a valve according to the present invention, FIG. 7 a section along an axis of rotation of a drive shaft of a gear pump, directed to the outside, of another embodiment, depicted schematically, and FIG. 8 a valve according to the present invention with a translatory displaceable movable part, and FIG. 9 a cross section through the two intermeshing gears of the gear pump of FIG. 1 taken perpendicular to their respective axes of rotation.
Figure 9:
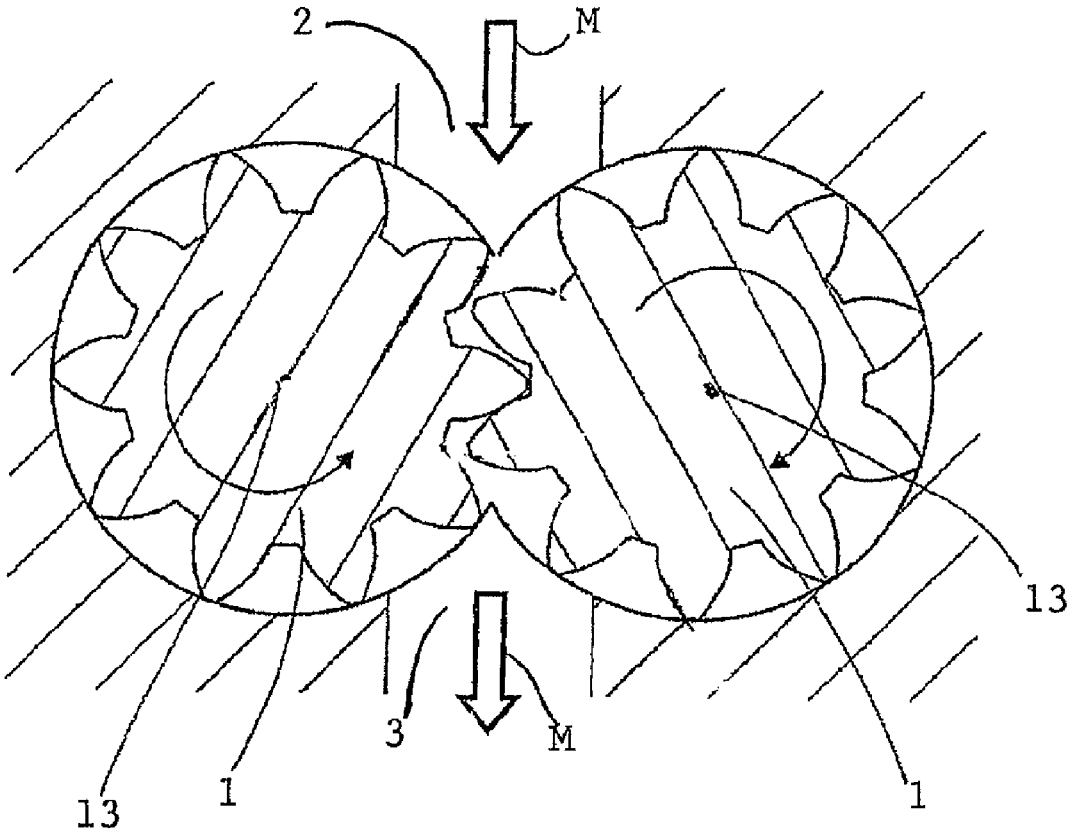

In FIG. 1, a section is depicted through a gear pump, on the one hand, the cutting plane running along the axis of rotation 13 of a shaft 8 and, on the other hand, perpendicularly to a plane, which is drawn by the two shafts of the gear pump. As a result, the second shaft not apparent in FIG. 1 lies behind or in front of the depicted shaft 8. A pumping medium M, which is a polymer or a so-called prepolymer, for example, is pumped from a suction side 2 and with a gear 1, i.e. in the teeth gaps, to a pressure side 3. The pumping medium M on the pressure side 3 is pressed out of the teeth gaps due to the intermeshing of the teeth of both gears. The gear 1 is mounted on a shaft 8 or it forms a workpiece together with the shaft 8. The intermeshing gears, 1, 1, of the gear pump, each rotatable about an axis of rotation, 13, 13, are depicted in FIG. 9.

FIG. 1 shows that section of the shaft, which is directed to the drive of the gear pump to the outside. Firstly, departing from the gear 1, a slide bearing section I follows, in which the shaft 8 is supported or borne in the housing 9, respectively. Subsequent to the slide bearing section I follows a dynamic sealing (sealing section II), which is implemented as so-called labyrinth sealing here in the form of a return conveying mandrel, and a static sealing (sealing section III), which is implemented by a packing of the stuffing box with a sealing medium here.

The slide bearings are lubricated in the gear pump depicted with the pumping medium M. Thus, the pumping medium M penetrates from the pressure side 3, preferably via a groove of the bearing lubrication 14, into a bearing gap of the slide bearing section I and causes a lubrication of the shaft 8. The dynamic sealing, which is subsequent to the slide bearing and the static sealing being subsequent to this, prevent that pumping medium M can get to the outside. It has to be paid attention to that no sealing liquid gets into the return duct 4, due to a high vacuum in the transition region between the slide bearing section I and the sealing section II (dynamic sealing), since the sealing liquid would then mix with and contaminate the pumping medium M. At the same time, the pressure may not be too high in the said transition region, since the pumping medium is pressed into the packing of the stuffing box and degrades there, which can lead to a destruction of the static sealing.

As already mentioned above, the use of a damper screw in the return duct 4 is already known. Primarily, this damper screw has been used for the complete closing of the return duct 4, like it always must be done for a temporary shutdown of the gear pump, for example. In addition, in each case it has been tried to comply with the afore-mentioned conditions in relation to the pressure ratios behind the slide bearing section I during operation of the gear pump. This is very difficult to achieve with a damper screw as it has been used in the known manner.

Figure 2:
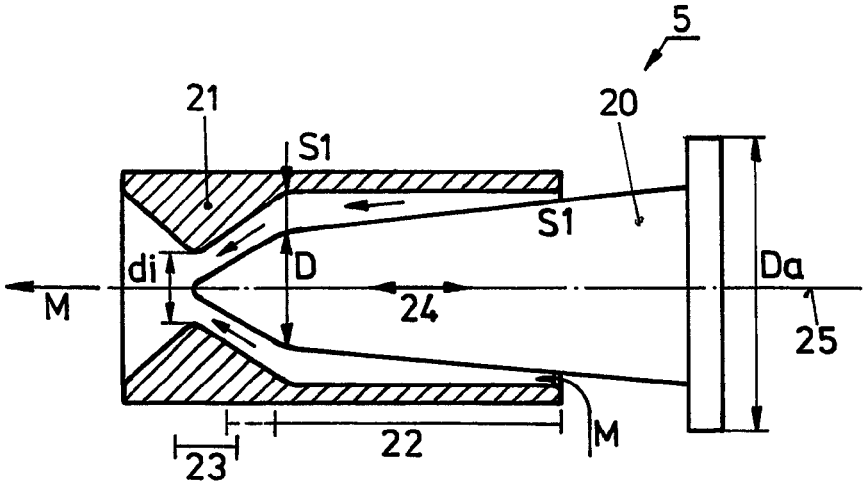
Figure 3:
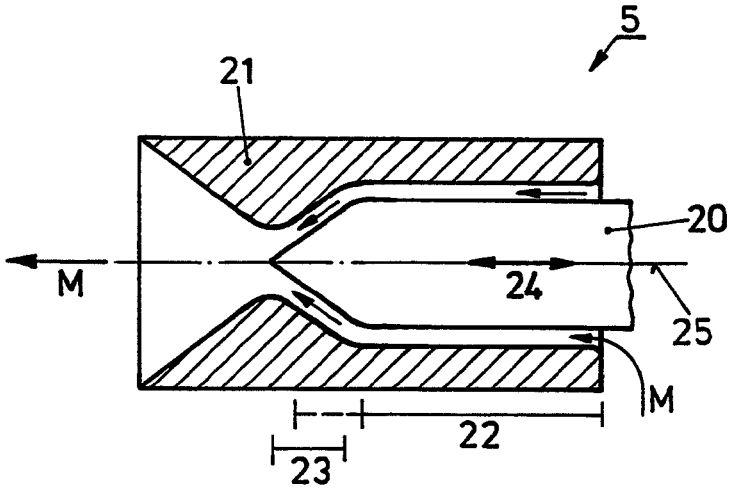
Figure 4:
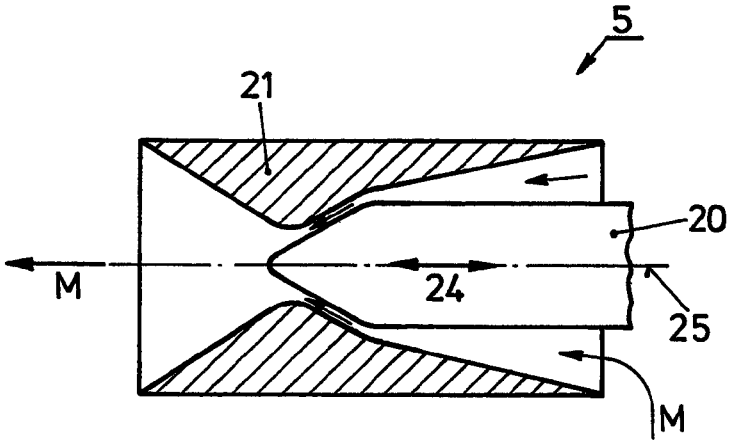

In FIGS. 2 to 4, valves 5 are depicted according to the present invention, which come into use in the return duct 4 (FIG. 1). The valves are all characterized by an improved adjustment characteristic compared to the known damper screw.

With the aid of the embodiment according to FIG. 2, in which a valve 5 is depicted as a section, the principle according to the present invention is explained. A movable part 20, as well referred to as pintle 20, for instance, is displaceable in a stationary part 21, as well referred to as sleeve, for instance, according to arrow 24. Thereby, the sleeve 21 can be shaped such that it can be embedded or displaced, respectively, as separate part into the return duct 4, or the return duct 4 comprises a corresponding form in the region of the valve 5 to be implemented. The advantage of an exchangeable sleeve 21 lies in a quick adaptability of the valve 5 to changed circumstances, as for example, if an optimization to a defined pumping medium must be carried out. Corresponding adjustments can also be carried out on the side of the pintle 20.

Particularly, the valve 5 according to the present invention is characterized in that both functions to be fulfilled by the valve, namely the opening/closing of the return duct 4 as well as the pressure adjustment in the transition region of the slide bearing section I to the dynamic sealing section II (FIG. 1), are mainly implemented separately. This does not imply that no superpositions between the functions are possible, that, however, an independency is present to a large extent between the functions. The coherences in this regard and the mode of action of the valve are explained in the following:

The pressure ratios in flow direction ahead and behind the valve 5 are identical to a large extent for a valve 5 that is completely open. By inserting the pintle 20 into the sleeve 21, the cross-section for the pumping medium M is firstly reduced. Therewith, a first increase of the pressure difference Δp results across the valve 5. This is the initial position for many implementations, i.e. this is the position with the smallest possible pressure difference Δp.

The cross-section surface is not changed anymore due to a further penetration of the pintle 20 into the sleeve 21—i.e. a width of gap S1, which is present between the pintle 20 and the sleeve 21, remains unchanged to a large extent—but it is only the penetration depth (in the following also called effective length or adjustment path) of the pintle 20 into the sleeve 21, which leads to a change of the pressure difference across the valve 5. Therewith, for the first time, an adjustment characteristic is obtained, which makes a large adjustment range possible for the pressure difference Δp across the valve 5. Therewith, an adjustment of the optimum pressure in the transition region between slide bearing section I and dynamic sealing section II is substantially easier.

For the further explanation of the invention, calculations were made, whose results can be summarized in the following formula, which is based on a couple of model assumptions for simplification:

$$\Delta p = \frac{Q \cdot 12 \cdot \eta \cdot x}{\pi \cdot D \cdot S1^3}$$

whereas

| | |
|---|---|
| Δp | resulting pressure difference across the valve |
| Q | throughput |
| η | viscosity |
| x | effective length or adjustment path |
| D | pintle diameter |
| S1 | gap width |

For the known damper screw, for which the preceding calculations are also valid, primary, the short annular gap, which can be characterized by the gap height S1, is reduced at the short end. This reduction has an effect on the calculations in the third power, which leads to a very high pressure change for small changes of the gap width S1.

In contrast thereto, an almost linear increasing of the pressure difference Δp is achieved with the device according to the present invention by advancing the pintle 20 into the sleeve 21, because—as can be explained with the preceding formula—the gap width S1 is only changed in a minor manner and only the adjustment path x is changed essentially. Therefore, the course of the pressure difference Δp in function of the adjustment path x is linear for a comparative long adjustment path in a first approximation. A change of the course takes place in that position, which is depicted in FIG. 2. The effective length x (adjustment path) is quasi elongated in this position, without that the pintle 20 is further pushed into the sleeve 21. Namely, the tapered pintle 20 and the tapered sleeve 21 comprise a distance to each other in this position, which corresponds approximately to the gap width S1 in the cylindrical region of the pintle 20 or the sleeve 21, respectively. Therewith, the effective length (adjustment path x), which is flown through by the pumping medium M in the valve with the same gap width S1, is elongated by the corresponding dimensions in the tapered region of the pintle. As result thereof, the pressure difference Δp increases proportional to this new effective length, which results in a first disproportional increase in the pressure difference Δp.

Now, by pushing the pintle further into the sleeve, the distance in the tapered region of the pintle 20 is thus smaller than the gap width S1 in the cylindrical-shaped section. Therewith, the pressure difference Δp across the valve increases disproportionally (i.e. the meaning of the effective length x decreases for the determination of the pressure difference Δp), and the distance (i.e. the gap width S1) determines now the pressure difference Δp across the valve in the third power. In other words, the function "opening/closing" now is active, which follows a strong nonlinear law and let the pressure difference Δp increase correspondingly strongly.

From the preceding explanations, the implementation of both functions "opening/closing" and "pressure adjustment" can be localized inside the valve 5: thus, the function "pressure adjustment" is locally allocated to a closing section 22 and the function "opening/closing" to a closing section 23, whereby the function "opening/closing" and, essentially, the function "pressure adjustment" is separately implemented. Therewith, the meaning of the expression "essentially" points to the fact that a certain overlapping is present in that region, in which it comes to a quasi elongation of the effective length. This is indicated by a dashed-lined elongation of the pressure adjustment section 22. In relation to the overall length of the pressure adjustment section 22, the overlapping is small. The overlapping range amounts to a maximum of 20% of the pressure adjustment section 22, for example, in particular, a maximum of 10% of pressure adjustment section 22.

Based on the preceding rather general remarks, a big diversity of embodiments of the outer shape of the pintle 20 and/or the inner shape of the sleeve 21 can be obtained. The embodiments are examples, which are shown in FIGS. 3 and 4. While the gap width S1 in the embodiment according to FIG. 3 is rather constant in the pressure adjustment section 22, the gap width S1 varies in the embodiments according to FIGS. 2 and 4, the variation in the gap width S1 being generated in one case by the outer shape of the pintle 20 (like in FIG. 2) and in the other case by the inner shape of the sleeve 21 (like in FIG. 4). Hence, the variation of the gap width S1 by the design of the pintle and/or the sleeve can be used to obtain desired adjustment characteristics.

It has been shown that the dimensions have to be adjusted as follows:

x 0.5*D . . . 5*D, particularly 3*D;

S1 0.008*D . . . 0.08*D;

di di<D, di=D/1.5 . . . D/1.2;

It is pointed out that the adjustment characteristic can particularly be adjusted with a variation of the gap width S1 across the adjustment section 22.

Figure 5A:
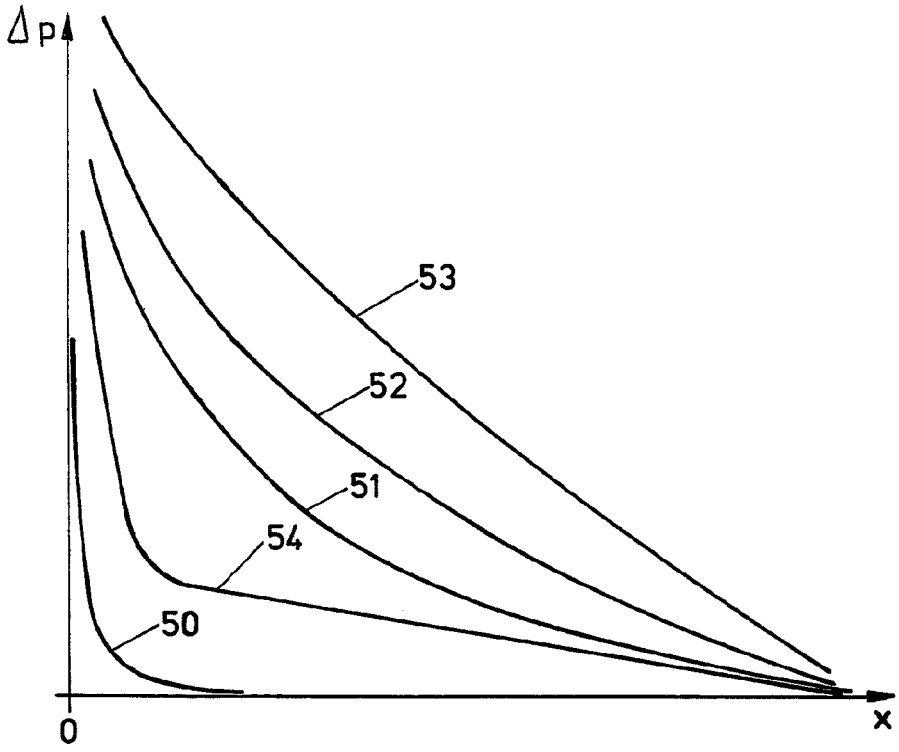

FIG. 5A shows the adjustment characteristics of a known damper screw (reference sign 50) and of different valves according to the present invention (reference signs 51, 52, 53 and 54), giving the adjustment path x of the pintle 20 with respect to the sleeve 21 on the abscissa. Hereby, the origin represents the valve completely closed. The pressure difference Δp is recorded on the ordinate.

The uttermost steep course 50 of the adjustment characteristic for gear pumps with the known damper screw is clearly visible in FIG. 5A. In contrast thereto, the courses 51 to 54 are clearly formed more flatly so that a simpler and more precise pressure adjustment is already recognizable from this. The courses 51 to 54 are linear within an adjustment range in first approximation. The linear range corresponds to the pressure adjustment section 22 (FIG. 2). The differences between the courses 51 to 54 can be obtained through different gap widths S1 (i.e. the gap width S1 is not constant across the effective length x) in the pressure adjustment section 22 (FIG. 2), as they are indicated in the FIGS. 2 to 4, for example. Thereby, the course 54 substantially shows a distinct linearity, which is a consequence of a constant gap width S1, as this is also the case in the embodiment according to FIG. 3.

Figure 5B:
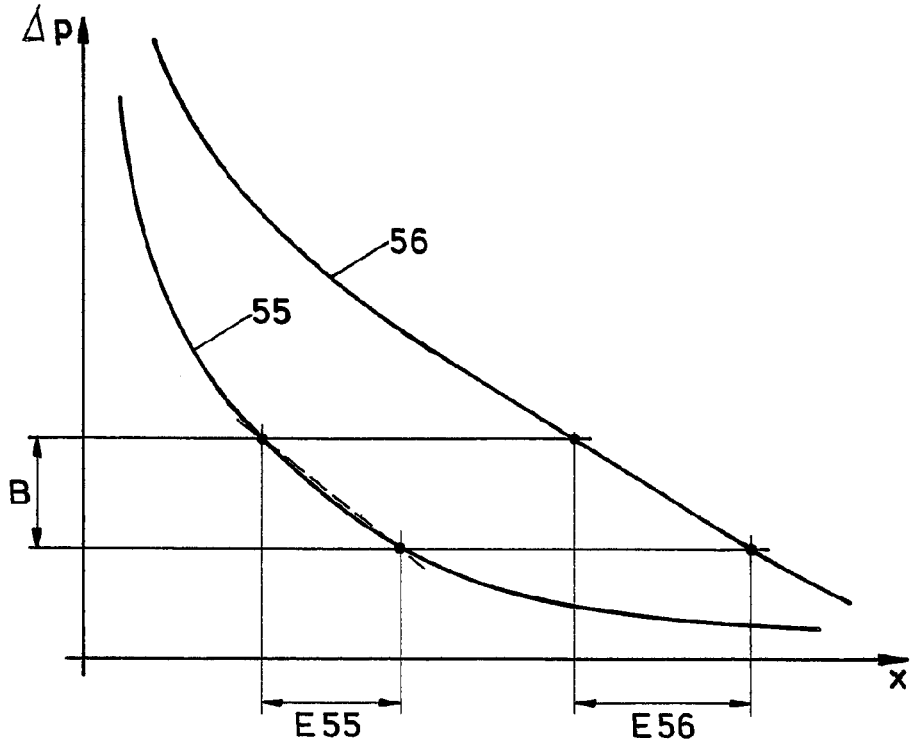

FIG. 5B shows two further courses 55 and 56, the course 55 being determined for a low-viscous pumping medium and the course 56 for a high-viscous pumping medium by using the same valve. Because the same valve was used for the determination of the courses 55 and 56, the pressure p to be adjusted is also in the same operating range B. The adjustment path x or the adjustment ranges E55 and E56 resulting from the operating range and the courses 55 and 56 are different due to the different viscosities of the different pumping media. As it clearly is apparent from the courses 55 and 56, there is a linear correlation between the adjustment path x and the pressure difference Δp in the adjustment ranges E55 an E56 in first approximation. Both of the endpoints in the adjustment range E55 were connected by a dashed line for the clarification of this fact.

The principle according to the present invention is further explained by referring to the gradients of the course of the pressure difference Δp in dependence on the adjustment path x with the aid of FIG. 5C.

Again, two adjustment characteristics are depicted in FIG. 5C, being about, on the one hand, a steep course 100 of the pressure difference Δp in function of the adjustment path x of a known valve and, on the other hand, a flat course 200 of a valve according to the present invention. Again, the value 0 has to be put in the origin of the course for the adjustment path x. The valve is in a completely closed state in this position. On the other hand, the pintle is backed out at maximum from the sleeve, the adjustment path being then $x_{max}$. Because % are used as units, the value for $x_{max}$ is 100%. The remaining pressure difference Δp for this maximum adjustment path $x_{max}$ corresponds to the residual pressure drop across the completely opened valve. Closing ranges $SB_{100}$ and $SB_{200}$, adjustment ranges $EB_{100}$ and $EB_{200}$ as well as so-called residual ranges $R_{100}$ and $R_{200}$ for the course 100 of the known valve, respectively for the course 200 of the valve according to the present invention, are given in FIG. 5C below the course for the pressure difference Δp in function of the adjustment path x. These ranges are (partly overlapping) sections of the abscissa (i.e. adjustment path x) of the depicted course. These ranges are defined by slopes (gradients) of the courses, the slope of a course Δp being defined through its differentiation to x as follows:

$$\text{Slope } g = \frac{d}{dx}\Delta p(x) = \frac{\Delta p_2 - \Delta p_1}{x_2 - x_1}$$

As unit for the slope arises "bar per percentage of the maximum adjustment path $x_{max}$". This unit applies for all values for the slope given in this description.

An adjustment range shows values for the slope g, which lie between 0.05 and 2.5, which makes an easy and comfortable (i.e. good-natured) adjusting of the pressure conditions for a gear pump possible.

Embodiments with more good-natured behaviour comprise slope values between 0.05 and 2.0, particularly between 0.05 and 1.75 or less. Slope values, which are bigger than 2.5, are not suitable for an adjustment of the pressure conditions. Hence, slope values bigger than 2.5 are allocated to the closing range. Finally, the slope values, which are smaller than 0.05 are as well not suitable in order to adjust the pressure conditions of a gear pump, since already for small changes of the pressure difference Δp, long adjustment paths x are necessary. For this reason, ranges with slope values, which are smaller than 0.05, are allocated to a residual range, in which the desired adjustments are referred to as useless.

The use of the afore-mentioned definitions for the courses of the pressure difference in function of the adjustment path x according to FIG. 5C results in the ranges recorded under the courses 100 and 200. While the closing range $SB_{100}$, the adjustment range $EB_{100}$ and the residual range $R_{100}$ result for the course 100 of the known valve, the closing range $SB_{200}$, the adjustment range $EB_{200}$ and the residual range $R_{200}$ result for the course 200 for the valve according to the present invention.

It clearly results from the comparison of the courses according to FIG. 5C for a valve known and according to the present invention that the adjustment range $EB_{200}$, which is essential for an easy and exact adjustment of the desired pressure in the gear pump, is much larger than the adjustment range $EB_{100}$ of the known valve. The adjustment range of the valve according to the present invention covers at least 50% of the maximum adjustment path $x_{max}$, preferably the adjustment range is 50% to 90% of the maximum adjustment path $x_{max}$, and more advantageously the adjustment range of the valve of the invention is 80% of the maximum adjustment path $x_{max}$. In contrast thereto, known valves show adjustment ranges, which do not cover over 15% of the maximum adjustment path $x_{max}$. Hence, while the largest section of the adjustable adjustment paths x of the valve according to the present invention lies in the adjustment range, the largest section of the adjustable adjustment paths x of the known valve lies in the residual range, which is not usable.

In FIG. 5C of the depicted embodiment of the valve according to the present invention, the adjustment range $EB_{200}$ covers 80%, the closing range $SB_{100}$ approximately 10% and the residual range $R_{200}$ also approximately 10% of the maximum adjustment path $x_{max}$. In contrast thereto, the known valve according to FIG. 5C comprises an adjustment range $EB_{100}$ of approximately 15%, a closing range $SB_{100}$ of approximately 10% and a residual range $R_{100}$ of approximately 80%. Particularly representative for the known valve is also an overlapping of the closing range $SB_{100}$ with the adjustment range $EB_{100}$. Thus, the adjustment of the pressure difference Δp for the known valve is actually carried out in the closing range $SB_{100}$, in which an adjustment of the pressure difference is particularly difficult due to the extremely steep course 100 (slope g>>2.5).

Figure 6:
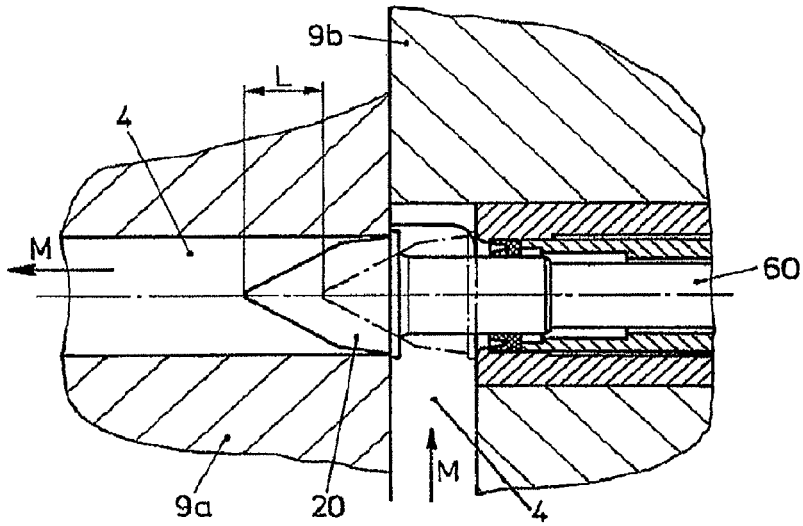

A further embodiment of the present invention is depicted in FIG. 6. The pumping medium M flown through the bearing gap is directed back via a return duct 4, which runs perpendicularly, to the suction side of the gear pump (FIG. 1), on the one hand, the return duct 4 is formed as drill hole in a housing part 9*a* and as a groove in a housing part 9*b*. In the corner of the perpendicular run of the return duct 4, an feeding unit 60 is provided, by which a pintle 20 is pushed into the drill hole, formed as a return duct 4. In contrast to the embodiments according to FIGS. 2 to 5, the arrangement of the two functions "opening/closing" and "pressure adjustment" is reversed compared to the embodiment according to FIG. 6: the pressure adjustment takes place on the side of the end of the pintle 20 and the function "opening/closing" on the side of the feeding unit 60. Therewith, also existing gear pumps can be equipped with a valve according to the present invention in an easy manner without that the housing of the pump must be changed.

It is noted that the pintle 20 is shown in the completely opened as well as in the completely closed position in FIG. 6. All in all, the pintle 20 can be displaced over a maximum length L (maximum adjustment path x).

It is conceivable for all embodiments of the pintle as well as of the sleeve to provide a cross-section deviating from a rotation-symmetry. Thus, it is particularly conceivable that the pintle and/or the sleeve comprise one of the following cross-sections:

Polygon, particularly a triangle, quadrangle or hexagon;

oval;

round.

Furthermore, the end of the pintle pointing in direction of the suction side can be embodied differently. Particularly, the end can be embodied tapered—and namely pointed or truncated—, globular or flat.

Finally, it is also conceivable that the pressure adjustment section 22 (FIG. 2) is divided into subsections in order to obtain a further embodiment for the adjustment characteristics. Each subsection can be individually adjusted to desired requirements.

Figure 7:
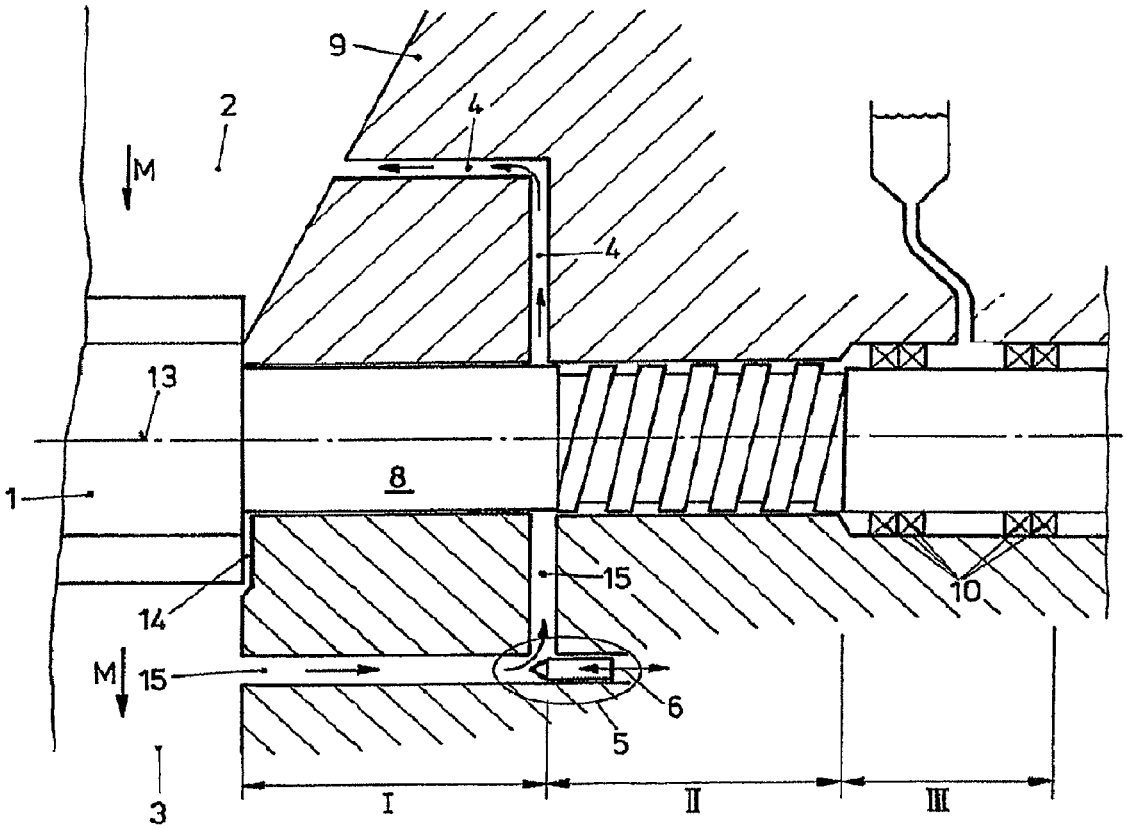

FIG. 7 shows, in allusion to the way of depiction according to FIG. 1, a further embodiment for a gear pump. In contrast to the embodiment according to FIG. 1, the gear pump comprises a feeding duct 15, which connects the pressure side 3 to the range between the slide bearing and the dynamic sealing. Furthermore, the valve 5 is not arranged in the return duct 4 but in the feeding duct 15. For the rest, the gear pumps are built up identically, which is why for further explanations it is referred to the description of FIG. 1.

The valve 5 according to FIG. 7 is again used for the pressure adjustment or opening/closing of the feeding duct 15, respectively, the afore-mentioned explanations about the valve 5 and the corresponding adjustment characteristics having also here their validity.

Figure 8:
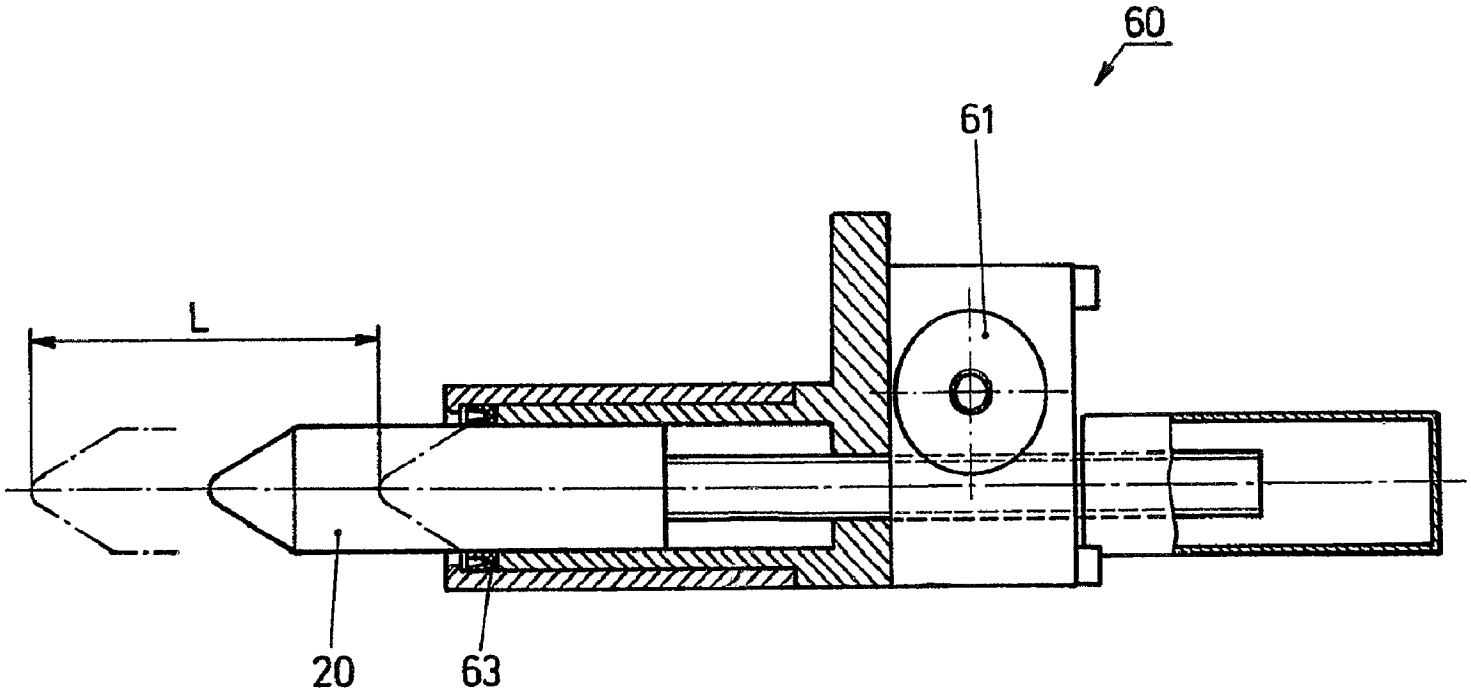
FIG. 8 a valve according to the present invention with a translatory displaceable movable part.

Finally, a special feeding unit 60 is depicted in FIG. 8, which is excellently suitable for the adjustment of the adjustment path x of the valves according to the present invention in combination with the afore-mentioned embodiments.

The known damper screws described initially perform a rotation around its own axis during the translatory displacement of the pintle 20. Therewith, the sealing, making sure that no pumping medium M flows in direction of feeding unit, are not only stressed by the actual translatory feeding movement, but, in addition, also by the rotation around the own axis. During the pressure adjustment and particularly also at a closing or opening of the return duct, respectively, the sealing is stressed so strongly that their life expectancy is susceptible to being restricted.

A further aspect according to the present invention leads to a considerable improvement of this problem. Thus, in using a mandrel lifting drive 61, it is possible that a mere translatory movement can be obtained. Thus, the sealing 63 are no more stressed by the combination of own rotation and translation of the pintle 20, but merely only by the actual translatory movement, which is necessary for the adjustment of the pressure or for the opening/closing of the valve. Therewith, the glide path of the sealing is reduced.

Further, the feeding unit 60 according to the present invention makes possible a substantial larger lift (maximum length L or maximum adjustment path x, respectively) so that the pressure adjustment characteristics can be implemented making an extremely fine adjustment possible.

Finally, the use of the mandrel lifting drive 61 allows an easier handling during the adjustment process. While the adjustments for the known damper screw must have been made very close to the rotating drive shaft, the adjustment of the embodiment according to the present invention can be carried out with a mandrel lifting drive 61 perpendicularly to the rotating drive shaft. Therewith, the access to the adjustment device is substantially improved and the danger of an injury of operating personnel by the rotating drive shaft is reduced.

Although, the feeding unit 60 is especially suitable in combination with the valve or the depicted embodiments according to the present invention, respectively, also a combination of the feeding unit according to the present invention with known valves leads to the advantages mentioned in connection with the mandrel lifting drive. For this reason, the feeding unit according to the present invention has to be looked at independently from the valve according to the present invention and hence deserves protection independent from the valve.

The invention claimed is:

1. Gear pump, comprising a housing (9) with at least two intermeshing gears (1) each with a shaft (8) supported by slide bearings (I) lubricated with pumping medium, the pumping medium (M) getting from a suction side (2) to a pressure side (3) and a return duct (4) being provided, which leads pumping medium (M) flowing to the outside via the slide bearing (I) back to the suction side (2), and with a valve (5), which includes a movable part and a stationary part (20, 21), for the adjustment of a pressure difference (Δp) in function of an adjustment path (x), which indicates a position between the stationary part and the movable part (20, 21), wherein the valve (5) has an adjustment range ($EB_{200}$), in which the pressure difference (Δp) in function of the adjustment path (x) has a slope between 0.05 and 2.5 bar per percentage of a maximum adjustment path ($x_{max}$), and wherein the adjustment range ($EB_{200}$) is at least 50% of the maximum adjustment path ($x_{max}$).

2. Gear pump according to claim 1, wherein the pressure difference (Δp) in function of the adjustment path (x) in the adjustment range ($EB_{200}$) has a slope between 0.05 and 1.75 bar per percentage of the maximum adjustment path ($x_{max}$).

3. Gear pump according to claim 1, wherein the valve has a closing range ($SB_{200}$) in which the pressure difference (Δp) in function of the adjustment path (x) is larger than 2.5 bar per percentage of the maximum adjustment path ($x_{max}$), the closing range ($SB_{200}$) being 10 to 15% of the maximum adjustment path ($x_{max}$).

4. Gear pump according to claim 1, wherein the valve (5) is contained in the return duct (4).

5. Gear pump according to claim 1, wherein the valve (5) is contained in a feeding duct (15), which leads from the pressure side (3) into the region arranged behind the slide bearing (I), viewed from the gears (1).

6. Gear pump according to claim 1, wherein the valve (5) includes a pressure adjustment section (22), which mainly serves for the pressure adjustment, and wherein the valve (5) is contained in the return duct and includes a closing section (23), by which the return duct can be is opened or closed, respectively.

7. Gear pump according to claim 1, wherein the movable part (20) is insert-able into the stationary part (21).

8. Gear pump according to claim 1, wherein the return duct contains the valve and the movable (20) and the stationary part (21) contact each other in a closing section (23), if the duct containing the valve (5) is closed.

9. Gear pump according to claim 1, wherein the stationary part (21) is an exchangeable sleeve.

10. Gear pump according to claim 1, wherein the valve (5) has the following dimensions:

x: 0.5*D . . . 5*D;

S1: 0.008*D . . . 0.08*D;

di: di<D, di=D/1.5 . . . D/1.2;

x being the adjustment path, D the diameter of the movable part (20), di the passage opening in a closing section (23) and S1 the gap width between the stationary (21) and the movable part (20).

11. Gear pump according to claim 1, wherein the movable part (20) is merely translatory displaceable.

12. Gear pump according to claim 11, further comprising a mandrel lifting drive (61) to displace the movable part (20) in translatory manner.

13. Gear pump according to claim 1, wherein the movable part (20) facing the end of the suction side has a shape selected from the group consisting of tapered, globular and flat.

14. Gear pump according to claim 1, wherein the movable part (20) has a cross-section selected from the group consisting of a triangle, a quadrangle, a hexagonan oval, and round.

15. Gear pump according to claim 1, wherein the valve includes a closing section (23) provided after a pressure adjustment section (22) in flow direction of the pumping medium (M).

* * * * *